US006077068A

United States Patent [19]

Okumura

[11] Patent Number: 6,077,068

[45] Date of Patent: Jun. 20, 2000

[54] PULSATED COMBUSTION APPARATUS AND A METHOD FOR CONTROLLING SUCH A PULSATED COMBUSTION APPARATUS

[75] Inventor: Yasushi Okumura, Nagoya, Japan

[73] Assignee: NGK Insulators, Ltd., Japan

[21] Appl. No.: 09/035,885

[22] Filed: Mar. 6, 1998

Related U.S. Application Data

[63] Continuation-in-part of application No. 08/696,226, Aug. 13, 1996.

[51] Int. Cl.[7] ..... F23C 11/04

[52] U.S. Cl. ..... 431/1; 431/6; 431/18; 431/62

[58] Field of Search ..... 431/1, 6, 12, 18, 431/62

[56] References Cited

U.S. PATENT DOCUMENTS

| | | | |
|---|---|---|---|
| 3,905,394 | 9/1975 | Jerde | 431/89 |
| 4,834,644 | 5/1989 | Snow | 431/1 |
| 5,078,317 | 1/1992 | Kenner et al. | 431/12 |
| 5,222,721 | 6/1993 | Drogue et al. | 431/1 |
| 5,302,111 | 4/1994 | Jouvaud et al. | 431/1 |
| 5,397,232 | 3/1995 | Nishimura | 431/1 |
| 5,428,951 | 7/1995 | Wison et al. | 431/1 |

FOREIGN PATENT DOCUMENTS 0524880 1/1993 European Pat. Off. .

OTHER PUBLICATIONS

Introduction of Pulsated Combustion Apparatus; Krom/Schroder—depicts prior art burner—no translation available (No Date).

*Primary Examiner*—Carl D. Price
*Attorney, Agent, or Firm*—Parkhurst & Wendel, L.L.P.

[57] ABSTRACT

A direct ignition type pulsated combustion apparatus including a burner provided in a combustion furnace, a combustion air line connected to the burner for feeding combustion air to the burner, a fuel gas line connected to the burner for feeding a fuel gas to the burner, an air valve and a fuel valve provided in the combustion air line and the fuel gas line, respectively. A plurality of actuators provided for the air valve and the fuel valve are adapted to open and close the air valve and the fuel valve, respectively. An air bypass line is provided in the combustion air line to bypass the air valve. A fuel bypass line provided in the fuel gas line for bypassing the fuel gas valve. A control unit actuates the opening/closing cycles and timings of the air and the fuel gas valves connected to the actuators, respectively, allowing the cycle time of opening and closing the air valve to be controlled independently of the cycle time of opening and closing the fuel gas valve.

4 Claims, 3 Drawing Sheets

PULSATED COMBUSTION APPARATUS AND A METHOD FOR CONTROLLING SUCH A PULSATED COMBUSTION APPARATUS

While the applicants believe that the invention disclosed and claimed herein was fully described in the patent application Ser. No. 08/696,226 now abandoned filed on Aug. 13, 1996 under 35 USC § 112, the present invention is filed as a Continuation-in-Part Application of the above patent application Ser. No. 08/696,226, to even more clearly describe the invention in some additional and different words and figures.

BACKGROUND OF THE INVENTION

1. Field of the Invention

The present invention relates to an improvement on a pulsated combustion apparatus and a method for controlling such a pulsated combustion apparatus, the apparatus and method being suitable for a ceramic article-firing furnace, and the like.

2. Related Art Statement

Burners for ceramic article-firing furnaces or the like generally have been controlled by adjusting the degree of opening of each burner during firing within a given narrow width, so that a target firing temperature curve may be realized. However, throttling the degree of opening of the burner generally decreases the amount of combustible gas from the burner. This controlling method has the problem that the kinetic energy of the combustible gas is reduced and can become insufficient depending upon the temperature range. Reduced kinetic energy of combustion gas makes the temperature distribution inside the furnace poorer and as a result causes an increase in the percentage of defective articles fired in such furnace. In order to solve such shortcomings, a combustion-controlled method called "pulsated combustion method" is known.

In the pulsated combustion method each burner in each zone inside the ceramic-firing furnace or the like is controlled by intermittently turning on and off the burner according to selected ignition timing at short time intervals under a given cycle. When the burner is turned on, the combustion state is kept at a maximum. On the other hand, when the burner is in a turned off state, the combustible state of the burner is kept low or even extinguished. The on-off cycle, the ignition timing and the amount of the combustible gas are set so that a desired firing curve and a maximum turn-down (maximum difference in output of the burner between the turn-off and turn-on) may be obtained.

Since the pulsated combustion method feeds a large amount of fuel and air into the furnace during a rising time of the turned-on operation, a large amount of kinetic energy is created, averting the problem of the kinetic energy becoming insufficient during the firing. Thus, a prior art shortcoming that the percentage of defective articles increases due to the poor temperature distribution inside the furnace is often eliminated. As a burner-ignition system, direct ignition using a high temperature heat source such as a spark plug or electric heating wire may be used. The pulsated combustion system includes a high-low system and a high-off system. "High" means the maximum combustible gas output state when the burner is turned on, "low" means a pilot burning state in which pilot burning flame is always maintained even when the combustion is in the turned-off state, and "off" means that the burner is completely extinguished when the combustion is turn-off state. The high-low system includes a direct ignition system and a pilot burner system. In the direct ignition system, the flame is maintained in the "low" state by using a nozzle of the same burner used in the "high" state. In the pilot burner system, the flame in the "low" state is maintained by using a pilot burner different from the nozzle of the burner to be used in the "high" state. The present invention relates to the former in the high-low system, that is, the invention relates to the technique (direct ignition technique) in which the flame in the "low" state is maintained by using the nozzle of the same burner used in the "high" state.

In the case of the direct ignition system, the flame of the "low" state is first formed by a spark plug in the operating furnace. Thereafter, pulsated combustion is effected by opening and closing an air feed valve and a fuel gas feed valve. In this system, while the same burner, the same air source, and the same fuel source are employed in both the "low" state and the "high" state, the feed lines are partially changed. At a starting time of each cycle of the pulsated combustion, the air feed valve and the fuel feed valve are opened to feed a mixed gas of combustion air and the fuel gas to the burner, so that the freshly fed mixed gas begins to be burned by using the flame in the "low" combustion state as an ignition source. At the termination time of each cycle of the pulsated combustion, the two valves are closed to convert the burner to the "low" combustion state.

In contrast, the pilot burner system ignites the pilot burner first to form the flame in the "low" state. At starting time, each cycle of the pulsated combustion, the fuel gas and combustion air are fed into the furnace through respective "high" combustion lines, and combustion in the 'high" state is started by using the flame of the pilot burner as an ignition source. At termination time each cycle of the pulsated combustion, the fuel gas feed line and the air feed line for the "high" combustion state are shut, and combustion is maintained only through the pilot burner.

FIG. 1 shows a pulsated combustion apparatus of a conventional direct ignition type in the pulsated combustion system for feeding combustion air and the fuel as to the burner in a pulsated manner. In FIG. 1, a burner 1 attached to a wall portion of a ceramic article-firing furnace is connected with a combustion air feed line 2 and a fuel gas feed line 3. The air feed line 2 is provided with a valve 4 for adjusting a feed amount of air, whereas the fuel gas feed line 3 is provided with a valve 6 for adjusting a feed amount of the fuel gas.

The valve 4 is provided with an actuator 5 for controlling the degree of opening of the valve 4, and a control unit and an air source are connected with the actuator 5. The valve 4 and the valve 6 are interlockingly connected with each other by means of a mechanical link 7. The air feed line 2 and the fuel gas feed line 3 are provided with an air bypass line 8 and a fuel bypass line 9 for bypassing the valves 4 and 6, respectively. The air bypass line 8 and the fuel bypass line 9 are provided with flow rate control valves 10 and 11, respectively. As shown, an ignition plug 12 is provided near an opening of a burner 1.

In the ceramic article-firing furnace or the like, its interior is divided into a plurality of zones, and one or more of the above pulsated combustion apparatuses are provided for each of the divided zones so that combustion of the pulsated combustion apparatuses may be controlled to give a desired temperature distribution in each of the zones.

In the pulsated combustion apparatus of FIG. 1, the fuel gas mixture is first ignited by the ignition plug 12; at turned-off time, the burner is kept at a low combustion level in the state that air and the fuel gas are fed to the burner through the bypass lines 8 and 9, respectively. During a transition period to the turn-on state, a turn-on signal is fed to the actuator 5 from the control unit, and then the valve 4 is opened to a given degree of opening as shown in FIG. 2. On the other hand, the opening motion of the valve 4 of the air feed line 2 is transmitted to the valve 6 of the fuel gas feed line 3 through the link 7, so that the valve 6 begins to be opened at a given time lag Δt, and then opened to a given opening degree. After the valve 6 begins to be opened, the air-fuel gas mixture is burned by a pilot combustion flame. By the present motion of the link, the feeding of air preferentially begins to be stopped at the time of terminating each combustion cycle, whereas the valve 6 begins to be closed after the air valve 4 begins to be closed at a given time lag Δt' via link 7 to stop the feeding of the fuel, as shown in FIG. 2.

In order to control the valves in a reverse manner to that of FIG. 2, the link may be adjusted so that at starting time of each combustion cycle, the fuel gas valve 6 is first opened and thereafter the air valve 4 is opened, whereas at termination time of the combustion cycle, the fuel gas valve 6 is first closed, and thereafter the air valve 4 is closed. This controlled state is shown in FIG. 3.

In FIG. 2, the feed pressure of combustion air is inevitably increased at the time of starting the combustion in each cycle preferentially to increase the feed pressure of the fuel gas, so that the combustible mixed gas becomes too lean. On the other hand, in FIG. 3, at the time of terminating the combustion of each cycle, the feed pressure of the combustion air is inevitably decreased subsequent to a decrease in the fuel gas, so that the combustible mixed gas becomes too lean. Therefore, in the conventional pulsated combustion apparatus, there is the possibility that the pilot combustion flame is extinguished at the time of starting or terminating of the combustion in each cycle. Further, during the cycle of turning on and off the combustion air and the fuel gas, the ignition timing and the amount of the fuel gas are set in view of various factors to prevent the pilot flame from being extinguished. It is not easy to effect such setting because feeding and stopping of air and the fuel gas are controlled in the state that the valves 4 and 6 are interlocked.

SUMMARY OF THE INVENTION

It is an object of the present invention to solve the above-mentioned problems of the prior art pulsated combustion apparatus, and to provide a direct ignition type pulsated combustion apparatus and a method for controlling such a direct ignition type pulsated combustion apparatus, where the apparatus and method can prevent a pilot flame from being extinguished on starting and terminating of the combustion in each pulsated cycle.

The present invention relates to the direct ignition type pulsated combustion apparatus which comprises a burner provided in a combustion furnace; a combustion air line connected to the burner for feeding combustion air to the burner; and an air valve and a fuel valve provided in the combustion air line and the fuel gas line, respectively. Actuators are provided for the air valve and the fuel valve and adapted to open and close the air valve and the fuel valve, respectively. An air bypass line is provided in the combustion air line for bypassing the air valve. A fuel bypass line is provided in the fuel gas line for bypassing the fuel gas valve. A control unit controls the opening/closing cycles and timings of the air valve and the fuel gas valve connected to the actuators, respectively, whereby the cycle and the timing of opening and closing the air valve is controlled independently of the cycle and the timing of opening and closing the fuel gas valve.

Further, the present invention also relates to a method for controlling the direct ignition type pulsated apparatus, said method comprising the steps of alternatively repeating a turned-on state and a turned-off state at a given cycle under a given timing; feeding a mixture of combustion air and a fuel gas to the burner; igniting the mixture in a burner-provided furnace in the turned-on state; maintaining a pilot combustion of a burner in the turn-off state; controlling the cycles and the timings of turning on and off the combustion air valve and the fuel gas valve such that the controlling of the cycle and the timing of turning on and off the air valve is effected independently of that of the cycle and the timing of a fuel gas valve. Therefore, the pilot combustion is prevented from being extinguished at starting time and termination time in each cycle.

According to the direct ignition type pulsated combustion apparatus, and the method for controlling the direct ignition type pulsated combustion apparatus, the cycle and the timing for turning on and off the combustion air valve can be controlled independently of the controlling of the cycle and the timing for turning on and off the fuel gas valve. Therefore, adjustment and controlling can be easily effected so that the pilot combustion may be prevented from being extinguished at starting time and termination time of the combustion of each cycle.

These and other objects, features and advantages of the invention will be appreciated upon reading the following description of the invention when taken in conjunction with the attached drawings, with the understanding that some modifications, variations and changes of the invention could easily be made by the skilled person in the art to which the invention pertains.

BRIEF DESCRIPTION OF THE DRAWINGS

For a better understanding of the invention, reference is made to the attached drawings, wherein.

DETAILED DESCRIPTION OF THE PREFERRED EMBODIMENT

Figure 1:
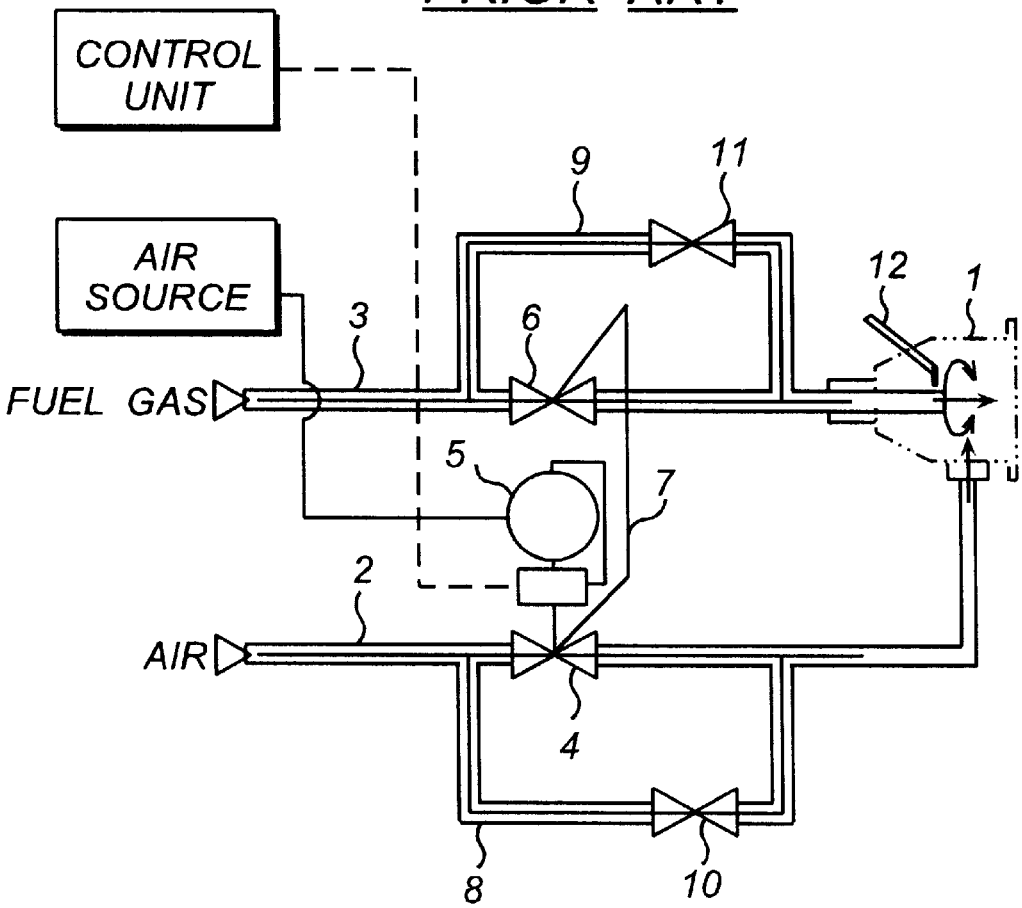
FIG. 1 PRIOR ART
FIG. 1 schematically illustrates the prior art direct ignition type pulsated combustion apparatus.
Figure 2:
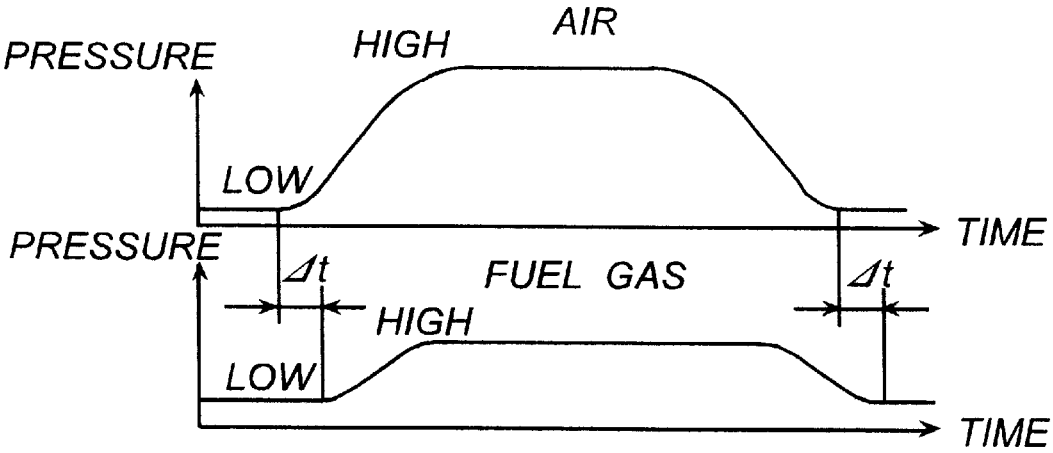
FIG. 2 PRIOR ART
FIG. 2 is a graph illustrating an example of the pulsated combustion with use of prior art direct ignition type pulsated combustion apparatus.
Figure 3:
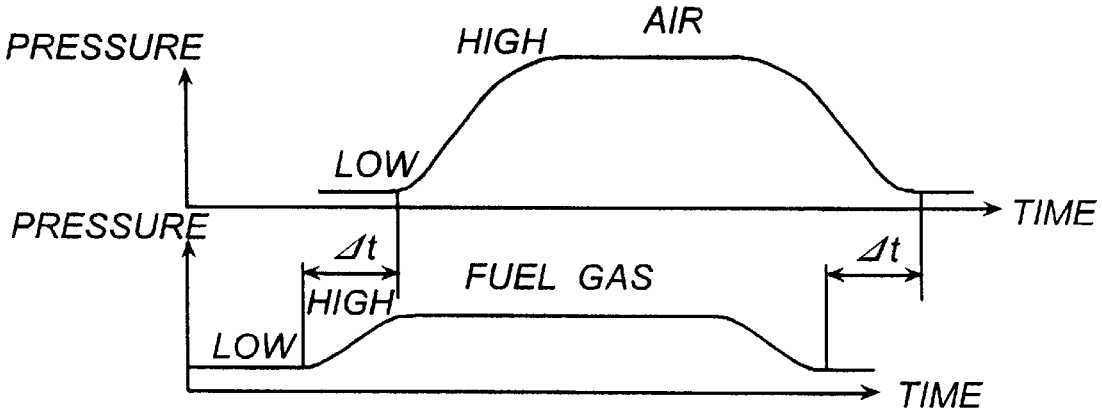
FIG. 3 PRIOR ART
FIG. 3 is a graph illustrating another example of the pulsated combustion with use of the prior art direct ignition type pulsated combustion apparatus of FIG. 1.
Figure 4:
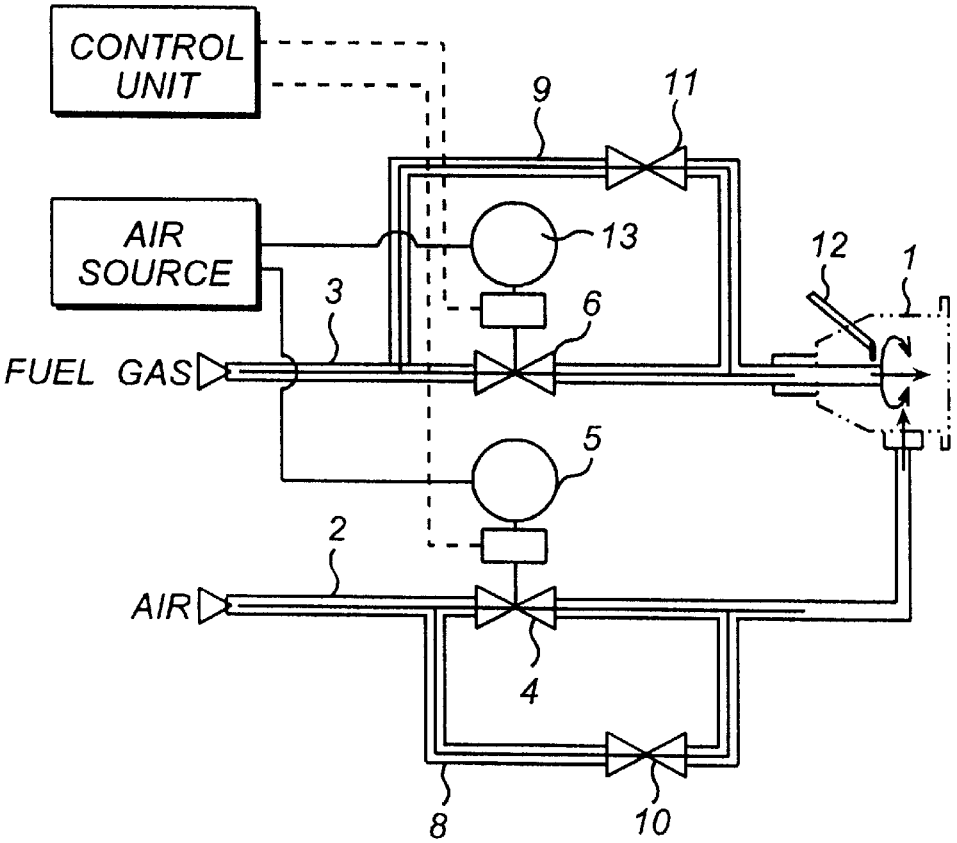
FIG. 4 schematically illustrates a direct ignition type pulsated combustion apparatus according to the present invention.

FIG. 4 depicts an embodiment of the direct ignition type pulsated combustion apparatus according to the present invention. The same or similar members and parts as shown in the direct ignition type pulsated combustion apparatus of FIG. 4 are given the same reference numerals as in FIG. 1, and their explanations are omitted for simplification. FIG. 4 depicts the direct ignition type pulsated combustion apparatus according to the present invention, that does not contain the link 7 of the prior art pulsated combustion apparatus of FIG. 1. An actuator 13 is provided separately from the actuator 5 for the valve 4 in the combustion air line 2 to control the degree of opening of the valve 6 in the fuel gas line 3. The actuator 13 is connected to the control unit and the air source. This construction allows for turned-on signals and turned-off signals to be inputted to the actuator 5 from the control unit independently of inputting of such signals to the actuator 13. The actuators 5 and 13 may be controlled by pneumatic pressure as in the conventional pulsated combustion apparatus.

According to the direct ignition type pulsated combustion apparatus of the present invention, since the cycle and the timing of opening and closing the valve 4 in the combustion air line 2 can be controlled independently of controlling of the cycle and the timing of opening and closing the valve 6 in the fuel gas feed line 3, the apparatus can be easily adjusted and controlled so that the pilot combustion may not be extinguished at times of starting and terminating of the combustion in each combustion cycle.

Consideration must be made of the following factors to prevent the pilot combustion from being extinguished, or in controlling: (i) opening and closing speeds of the valves 4 and 6 (changes in the air feed speed and the fuel gas feed speed at times of starting and terminating each pulsated combustion cycle), (ii) appropriate setting of the opening and closing timings of the valves 4 and 6, (iii) no adverse effect of the flame state to be given to articles in the furnace when the valves 4 and 6 are opened or closed. The above (i) to (iii) need to be satisfied simultaneously.

Figure 5:
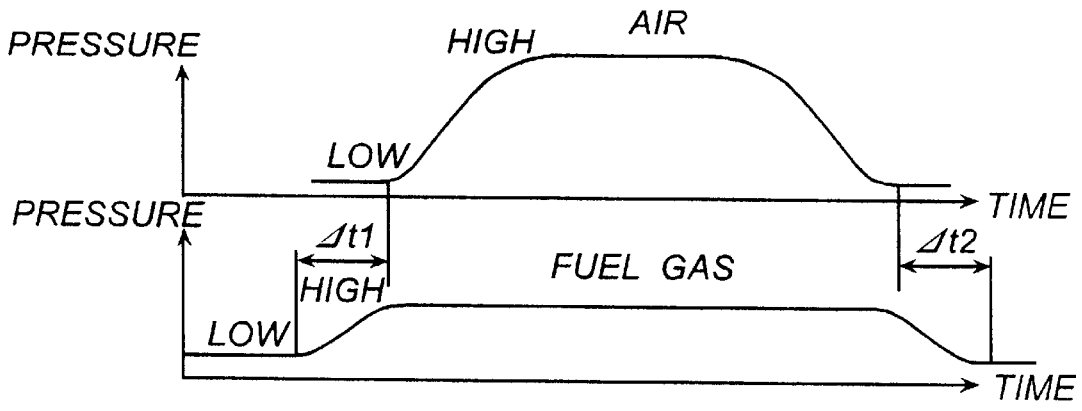
FIG. 5 is a graph illustrating an example of the pulsated combustion with use of the direct ignition type pulsated combustion apparatus of FIG. 4.

FIG. 5 depicts an embodiment of the method for controlling the pulsated combustion of the direct ignition type pulsated combustion apparatus according to the present invention. In this embodiment, the feed pressure of the fuel gas is raised at the starting time of the combustion in each pulsated combustion cycle prior to the increase in the feed pressure of the combustion air, whereas the feed pressure of the fuel gas is decreased at the time of terminating the combustion in each pulsated combustion cycle subsequent to the decrease in the feed pressure of the combustion air. That is, when the combustion in each pulsated combustion cycle is to be started, the pilot combustion is maintained and the fuel gas previously fed can be instantly burned to prevent the pilot combustion from being extinguished. On the other hand, when the combustion in each pulsated combustion cycle is to be terminated, the pilot combustion can be maintained without being extinguished under feeding of an excessive amount of air.

As mentioned above, according to pulsated combustion apparatus of the present invention, the valves in the combustion air line and in the fuel gas line are provided with the actuators, respectively, to make it possible to independently control the turned-on and turned-off timing of the combustion air valve, from the controlling of the turned-on and turned-off timing of the fuel gas valve. Therefore, when the turned-on and turned-off signals are appropriately outputted to the actuators from the control units, the pilot combustion can be maintained during termination and the pulsated combustion can be stably effected, including transition time periods from the turned-off and the turned-on and vice versa.

What is claimed is:

1. A direct ignition type pulsated combustion apparatus comprising:

a combustion air line connected to a burner for feeding combustion air to the burner;

a fuel gas line connected to the burner for feeding a fuel gas to the burner;

an air valve and a fuel valve provided in the combustion air line and the fuel line, respectively;

a plurality of actuators provided for the air valve and the fuel valve, said actuators being adapted to open and close the air valve and the fuel valve, respectively;

an air bypass line provided in the combustion air line for bypassing the air valve;

a fuel bypass line provided in the fuel gas line for bypassing the fuel gas valve; and a control unit for controlling opening and closing cycles, timings of the air valve, and the fuel gas valve connected to the actuators, respectively, whereby the cycle and the timing of opening and closing the air valve is controlled independently of the cycle and the timing of opening and closing the fuel gas valve such that a fuel pressure may be increased prior to an increase in air pressure at a start of a burn cycle and the air pressure may decrease prior to a decrease in fuel pressure at an end of a burn cycle.

2. The apparatus of claim 1, wherein said air valve and said fuel valve are pneumatic valves controlled with a pneumatic pressure or vacuum, and said pneumatic valves are capable of being partially opened.

3. A method for controlling the direct ignition type pulsated apparatus, said method comprising:

alternatively repeating a turned-on state and a turned-off state at a given cycle under a given timing;

feeding a mixture of combustion air and a fuel gas to the burner and igniting the mixture in a burner-provided furnace in the turned-on state;

maintaining a pilot combustion of a burner in the turned-off state, and controlling the cycles and the timings of turning on and off the combustion air valve and the fuel gas valve such that the controlling of the cycle, and the timing of turning on and off an air valve, is effected independently of that of the cycle and the timing of a fuel gas valve, whereby the pilot combustion is prevented from being extinguished at starting time and terminating time of combustion in each cycle wherein a feed pressure of the fuel is raised at a starting time of combustion in each pulsated combustion cycle prior to an increase in feed pressure of the combustion air, and the feed pressure of the fuel is decreased at a terminating time of the combustion in each pulsated combustion cycle subsequent to decrease in the feed pressure of the combustion air.

4. The method of claim 3, wherein controlling of cycles and timings of turning on and off the combustion air valve and the fuel gas valve are controlled by a pneumatic pressure or vacuum.

* * * * *

UNITED STATES PATENT AND TRADEMARK OFFICE

CERTIFICATE OF CORRECTION

PATENT NO. : 6,077,068
DATED : June 20, 2000
INVENTOR(S) : Yasushi Okumura

It is certified that error appears in the above-identified patent and that said Letters Patent is hereby corrected as shown below:

On page 1, Column 1, add: --[30] Foreign Application Priority Data: August 31, 1995 [JP] Japan .....7-223410--.

Signed and Sealed this

Third Day of July, 2001

*Attest:*

Nicholas P. Godici

*Attesting Officer*

NICHOLAS P. GODICI
*Acting Director of the United States Patent and Trademark Office*